US007054572B2

(12) United States Patent
Baruch et al.

(10) Patent No.: US 7,054,572 B2
(45) Date of Patent: May 30, 2006

(54) METHOD AND APPARATUS FOR SELECTIVE FUSER ROLLING COOLING

(75) Inventors: Susan C. Baruch, Pittsford, NY (US); Alan R. Priebe, Rochester, NY (US); Thomas M. Plutchak, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 76 days.

(21) Appl. No.: 10/795,051

(22) Filed: Mar. 5, 2004

(65) Prior Publication Data

US 2004/0190925 A1 Sep. 30, 2004

Related U.S. Application Data

(60) Provisional application No. 60/459,110, filed on Mar. 31, 2003.

(51) Int. Cl.
*G03G 15/20* (2006.01)

(52) U.S. Cl. ..... 399/69; 399/70; 399/334; 219/216

(58) Field of Classification Search ..... 219/216; 399/67, 69, 70, 45, 320, 324, 328, 330, 334
See application file for complete search history.

(56) References Cited

U.S. PATENT DOCUMENTS

| | | | | |
|---|---|---|---|---|
| 4,963,943 | A | 10/1990 | Tamary | |
| 5,787,321 | A | 7/1998 | Nishikawa et al. | |
| 5,991,565 | A * | 11/1999 | Hanyu et al. | 399/69 |
| 6,532,348 | B1 | 3/2003 | Allmendinger | |
| 6,539,185 | B1 * | 3/2003 | Hanyu et al. | 399/67 |
| 6,636,718 | B1 * | 10/2003 | Yura et al. | 399/333 |

* cited by examiner

*Primary Examiner*—Hoang Ngo
(74) *Attorney, Agent, or Firm*—Donna P. Suchy

(57) ABSTRACT

The present invention is in the field of electrophotographic printers and copiers. More specifically this invention relates to the fuser apparatus used to fuse an image on a receiving sheet. According to just one aspect of the invention, an apparatus and process for fixing toner images to a receiving sheet is provided. The apparatus may include a fuser having a run condition and an idle condition, the fuser having a fuser roller, a fuser roller heater, and a fuser temperature sensor which inputs to a logic and control system which controls the heating of the fuser roller heater. The fuser roller may be cooled during or after the idle condition, prior to the first receiving sheet entering the fuser. The fuser roller has end portions and a middle portion, and the middle portion may be cooled relative to said end portions. Additional aspects and representative embodiments are described herein.

31 Claims, 4 Drawing Sheets

METHOD AND APPARATUS FOR SELECTIVE FUSER ROLLING COOLING

RELATED APPLICATIONS

This application claims the benefit of prior provisional application Ser. No. 60/459,110 filed Mar. 31, 2003.

BACKGROUND

The present invention is in the field of electrophotographic printers and copiers. More specifically this invention relates to the fuser apparatus used to fuse an image on a receiving sheet.

Most heated roller fusing systems for fixing toner images to a receiving sheet heat a roller called the fusing roller. An unheated pressure roller forms a nip with the fusing roller. The receiving sheet is fed into the nip with an unfixed toner image contacting the fusing roller. The heated fusing roller then 'fuses' the image to the receiving sheet.

As heat is removed from the fuser roller by several sheets of paper, the temperature sensor tells the heater to turn on full, and the fuser roller end temperatures rise slightly higher than the temperature of the fuser roller at its center. This is because more heat is being removed from the center of the fuser roller (by the receiving sheets) than from the ends. This results in greater thermal expansion at the ends of the fuser roller than at its center. This in turn produces a tentering force that keeps the trail edges of the sheets in tension and prevents wrinkling.

After a fuser has been idle for approximately 5 minutes or more, the end temperatures of the fuser roller are slightly lower than the temperature of the middle portion of the fuser roller, due to heat dissipation at the ends. The effect of this temperature profile is that the first few copies (or prints) made have a greater tendency to become wrinkled as they go through the nip because the desired tentering force is insufficient. Tentering is a force that keeps the trail edge of the sheets in cross-track tension as they pass through the fuser in order to minimize wrinkling, i.e. outwardly opposing forces on the sheet in a direction transverse to the direction of motion of the sheet and in the same plane as the sheet. This may be accomplished by providing differential overdrive in the fuser nip. In a prior art device a tentering force is generated with a fuser roll that has a larger outside diameter on the ends than at the center (a "flared" profile).

Further, after a fuser has been idle for a few minutes, the first few sheets experience a 'temperature droop'. That is, the fuser roller temperature decreases as a function of time due to the first few sheets removing heat faster than it can be replenished. This reduces the effectiveness of the image fusing on these first sheets. An apparatus for mitigating thermal droop is disclosed in U.S. Pat. No. 4,963,943, the contents of which are fully incorporated by reference as if set forth herein.

Previous fuser roller temperature control devices have focused on maintaining a relatively constant temperature along the axis of the fuser roller. U.S. Pat. No. 5,787,321, by Nishikawa et al discloses a Temperature Controlling Device for a Fixing Unit. The purpose of this device is to prevent overheating of any portions of the fixing (fusing) roller. The control is based on a differential temperature between two sections of the roller, when the differential becomes too great, the cooling fans are either turned on or off.

In U.S. Pat. No. 6,532,348, by Allmendinger discloses a Method and Device for Generating and Adjusting Temperature Values in a Fixing Roller of a Toner Image Fixing Unit.

The purpose of this device is to allow for homogeneous warming of the fixing roller along its axial length as determined on the basis of a determined core temperature of the fixing roller.

A fuser apparatus and method is desired which would create a non-homogeneous temperature along a fuser roller axial length, thus allowing the first sheets passing through to see the same tentering force as the later sheets passing through, thus preventing wrinkling on all the sheets. A method is also desired which would prevent temperature droop, thus allowing the first few sheets to be exposed to the same fuser roller temperature as the later sheets, thereby improving the quality of image fusing.

DETAILED DESCRIPTION

Various aspects of the invention are presented in FIGS. 1–6 which are not drawn to scale and in which like components are numbered alike. According to one aspect of the invention, the thermal response of the fuser with sheets being fed through the fuser is simulated in the fuser prior to feeding sheets through the fuser. The thermal response may be simulated in a manner that minimizes thermal droop, or it may be simulated in a manner that maintains a tentering force, or it may be simulated in a manner that accomplishes both. According to a further aspect of the invention, the thermal response of the fuser with sheets being fed through the fuser is controlled to maintain a desired tentering force. The desired tentering force may be varied based on sheet width, or sheet heat absorbing capacity, or sheet stiffness, or combinations of these (all combinations thereof being included within the purview of the invention).

Figure 1:
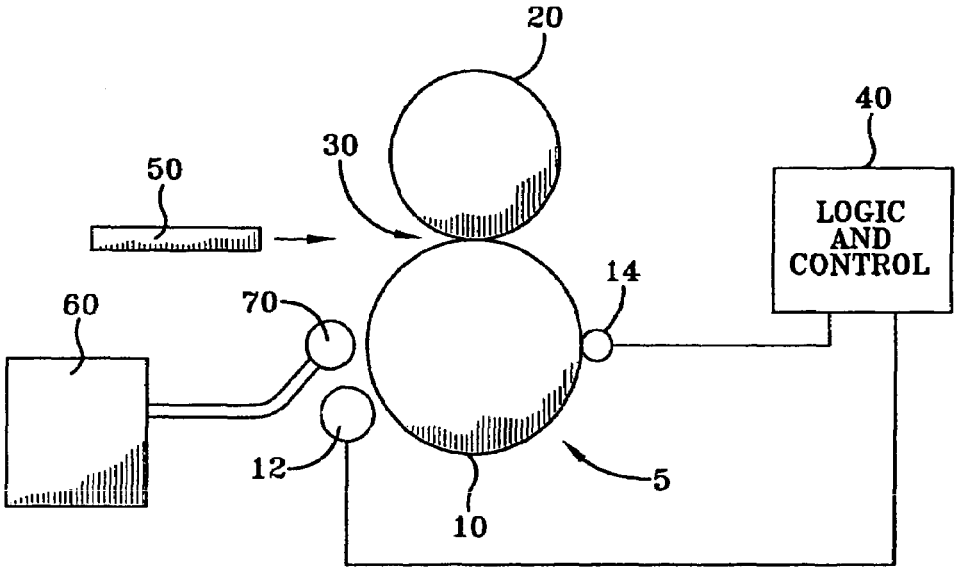
FIG. 1 is an end view of a fuser according to an aspect of the invention.

FIG. 1 shows a fuser 5 which includes a fuser roller 10 and a pressure roller 20. The fuser 5 further has a fuser roller heater 12, and a fuser temperature sensor 14, which inputs to a logic and control system 40 which controls the heating of the fuser roller heater 12. The fuser 5 has a run condition, and an idle condition. The fuser roller 10 and the pressure roller 20 form a nip 30. A receiving sheet 50 is considered to have entered the fuser 5 when it has entered the nip 30. The heater 12 may be electrothermal, radiative, convective, or other heat source suitable for fusing images, internal or external to the fuser roller, the particular type of heat source not being critical in the practice of the invention.

According to an aspect of the invention, an improved method of operation of a fuser 5 for fixing toner images to a receiving sheet 50 comprises cooling the fuser roller 10 during or after the idle condition, prior to the first receiving sheet 50 entering the fuser 5, such that the fuser roller 10 is cooled enough to cause the logic and control system 40 to activate the fuser roller heater 12. By cooling the fuser roller 10, and activating the fuser roller heater 12 prior to the arrival of the first receiver sheet 50, the fuser run condition is simulated. This helps prevent thermal droop because it eliminates the lag time between the arrival of the first receiving sheet 50 and the activation of the fuser roller heater 12.

There are many ways in which the fuser roller may be cooled. One such way is blowing a gas, such as air, onto the fuser roller 10, or drawing a gas, such as air, over the fuser 10. Another way would be to have a cooling or heat sink roller 15 in contact with the fuser roller 10 (see FIG. 6). Although these cooling methods are detailed, this does not limit the invention to these cooling methods, as any appropriate cooling method is within the purview of this invention.

Figure 2:
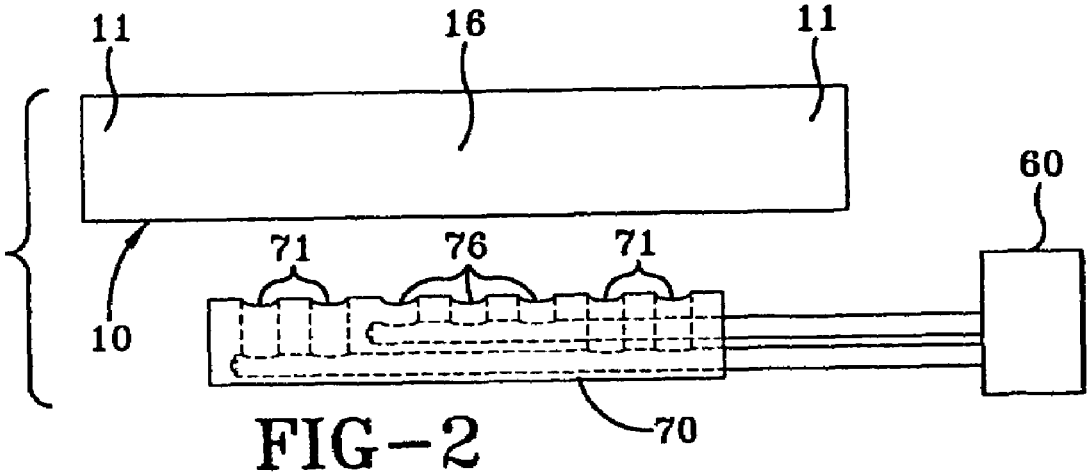
FIG. 2 is a side view of a fuser roller and cooling device, according to an aspect of the invention.
Figure 3:
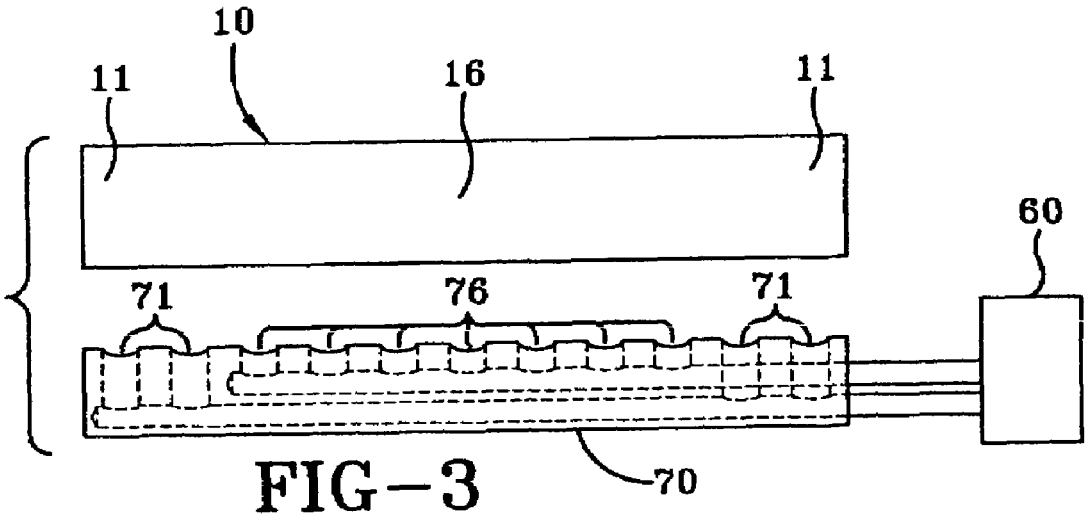
FIG. 3 is a side view of a fuser roller and cooling device, according to an aspect of the invention.
Figure 4:
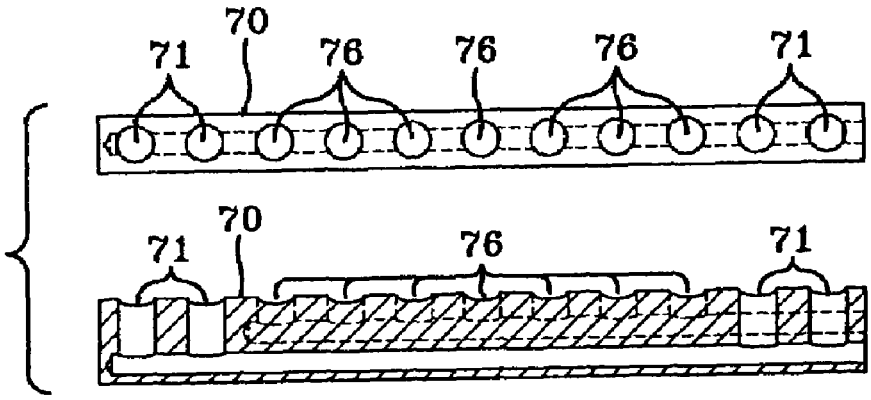
FIG. 4 is a side view of an cooling device according to an aspect of the invention.

FIGS. 2–4 detail a cooling method of directing a cooling fluid at the fuser roller 10. According to an aspect of the invention, the fuser roller 10 has end portions 11 and a middle portion 16, and the cooling is directed at the fuser roller middle portion 16. In this example, that means the fluid is directed onto the fuser roller middle portion 16. According to a further aspect of the invention, the fuser roller end portions 11 may be cooled independently, or in conjunction with the fuser roller middle portion 16. For example, the temperature of the end portions 11 may tend to increase as time progresses from a beginning of the run condition, so the end portions 11 may be cooled during the run condition relative to the beginning of the run condition in order to prevent overheating.

In a further aspect of the invention, the fuser roller 10 is cooled for a predetermined amount of time. According to a further aspect of the invention, the fuser roller or just the middle portion 16 is cooled after the run condition, for example to prevent an over-temperature condition. In any of the embodiments of the invention, only the middle portion 16 may be cooled, although both the end portions 11 and the middle portion 16 are cooled.

Figure 7:
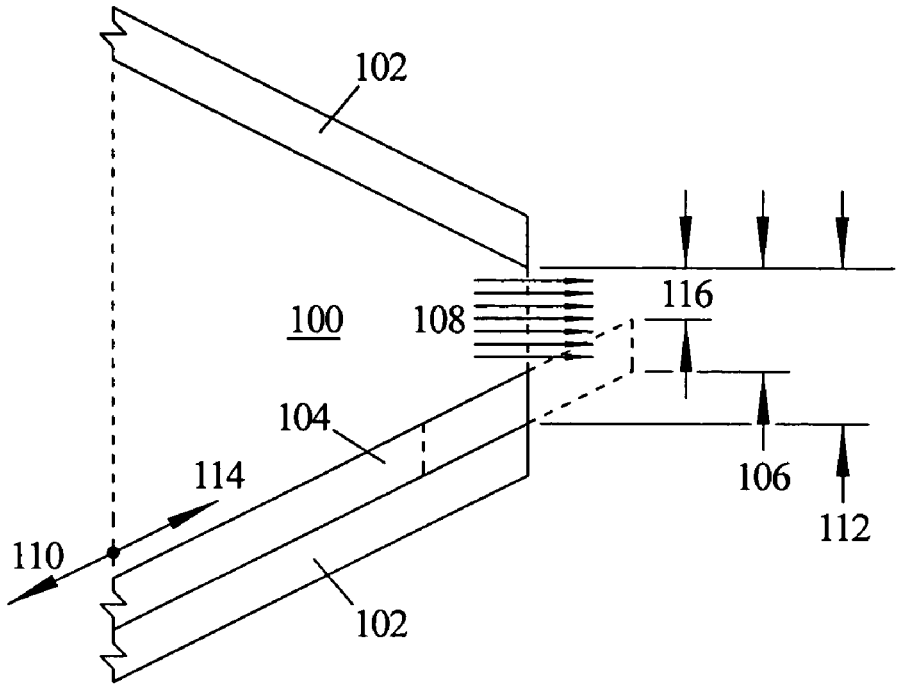
FIG. 7 is a cross-sectional view of a cooling nozzle according to an aspect of the invention.

Referring now FIG. 7, a cross-sectional view of a cooling nozzle 100 is presented having a lengthwise dimension extending perpendicular to the sheet. Nozzle 100 comprises nozzle sides 102 and an adjustable element 104 adjacent one or both of the nozzle sides 102. At the position shown in FIG. 7, the nozzle 100 blows cooling fluid through an area 106, as indicated by arrows 108. Moving the adjustable element 104 in the direction of arrow 110 (new position shown in dashed lines) increases the area through which cooling fluid blows, indicated by area 112. Moving the adjustable element 104 in the direction of arrow 114 (new position shown in dashed lines) decreases the area through which cooling fluid blows, indicated by area 116. An array of adjustable elements 104 may be provided adjacent each other in the lengthwise direction and independently controlled in order to alter the flow of cooling fluid according to a lengthwise distribution.

Figure 8:
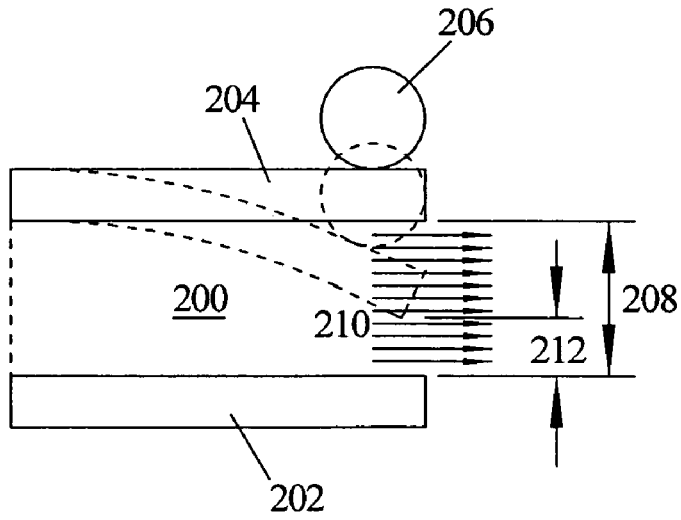
FIG. 8 is a cross-sectional view of a cooling nozzle according to an aspect of the invention.

A cross-sectional view of another embodiment, nozzle 200, is presented in FIG. 8. Nozzle 200 comprises a nozzle sides 202 and 204. Nozzle side 204 is deflectable. A deflecting element 206 is positioned against the nozzle side 204, and cooling fluid blows through an area 208 as indicated by arrows 210. The deflecting element 206 may be pressed against the nozzle side 204 which deflects the nozzle side 204 (deflected position shown in dashed lines) and narrows the area through which cooling fluid blows, as indicated by area 212. The nozzle side 204 is elastic and returns moves with the deflecting element 206 as it is moved back to its original position. An array of deflecting elements 206 may be provided adjacent each other in the lengthwise direction and independently controlled in order to alter the flow of cooling fluid according to a lengthwise distribution.

The adjustable element 104 and deflecting element 206 may be independently controlled by any suitable means, for example screws, cams, levers, pneumatics, hydraulics, and electromechanical devices (including solenoids, motors and stepper motors). An array of such control elements may be provided to control a lengthwise array of elements 104 and 206.

Figure 5:
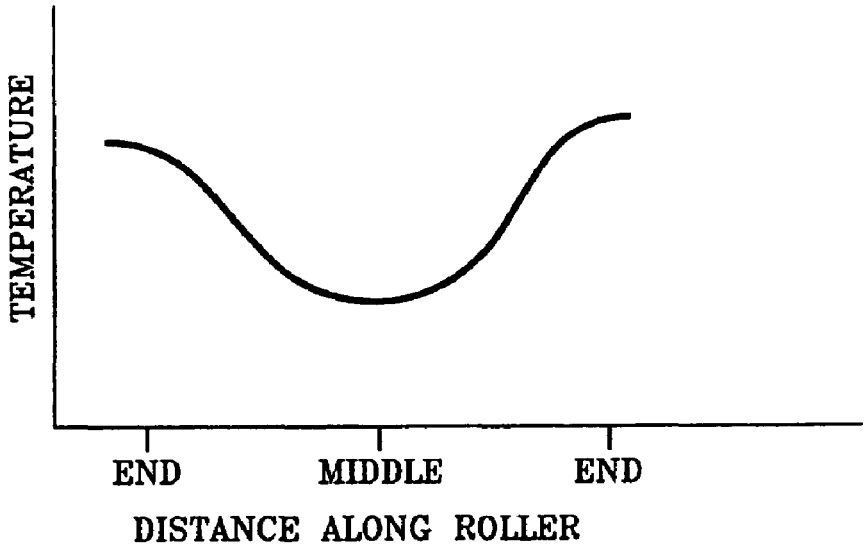
FIG. 5 is a temperature profile according to an aspect of the invention.
Figure 6:
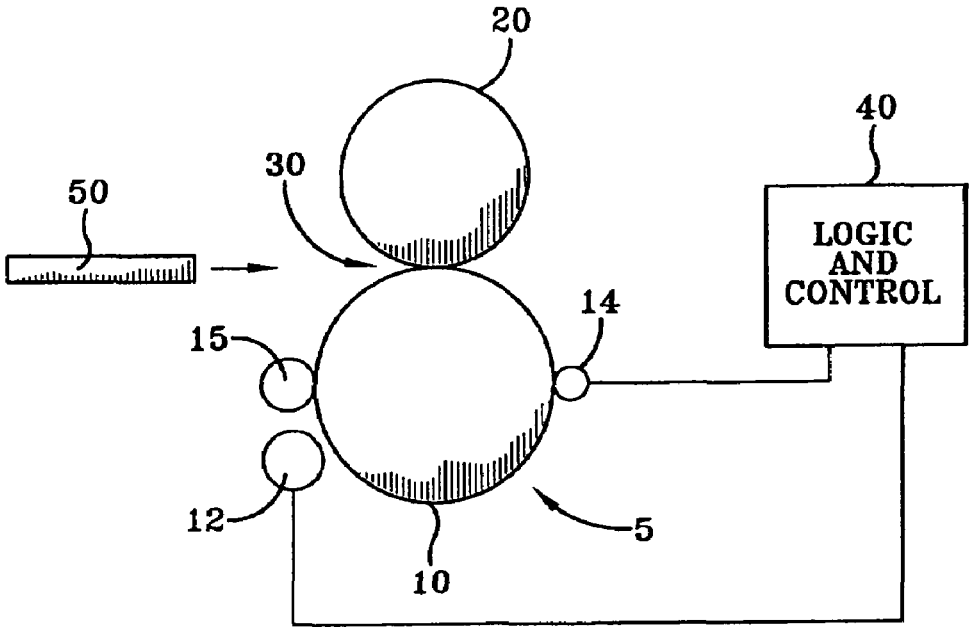
FIG. 6 is an end view of a fuser according to an aspect of the invention.

Several temperature sensors 14 may be provided along the length of the fuser roller 10. These various temperatures give a temperature profile of the fuser roller 10. FIG. 5 shows one typical fuser roller 10 temperature profile for a fuser 5 during operation. In a further embodiment, the fuser roller 10 would be cooled until the fuser roller 10 achieves a predetermined temperature profile. The logic and control system 40 may then be used to delay the feeding of the first receiving sheet 50 until the fuser roller 10 achieves the predetermined temperature profile. According to another aspect of the invention, the logic and control system is responsive to the temperatures 14 and controls cooling to maintain a desired temperature profile. The desired temperature profile may vary depending upon the size, weight, thickness, stiffness, and heat absorbing capacity of the sheet, these variables as discussed elsewhere herein.

In various aspects of the invention, the amount of heat drawn from the fuser roll is varied to achieve a desired result, including minimizing thermal droop and/or maintaining sheet tentering force. For example, receiving sheets 50 can be of various weights. Lighter weight sheets are more likely to wrinkle than heavier weight sheets. Thus lighter weight sheets need the fuser roller ends 11 hotter than do heavier weight sheets to prevent wrinkling. Thus, in a further embodiment of the invention, the heat absorbing capacity of the receiving sheet may be input to the logic and control system 40, and the logic and control system 40 adjusts the predetermined amount of time that the fuser roller 10 is cooled according to the receiver sheet 50 heat absorbing capacity. According to further embodiments, the heat absorbing capacity of the receiving sheet may be input manually, or by using a look-up table, or by sensing with a sensor, or by sensing the power being drawn by the fuser heat source. For example, heavier-weight sheets and sheets having a higher heat capacity absorb more heat during the fusing process, which could be determined in advance, and be compiled in a look-up table. Depending on the weight of the receiving sheet, the logic and control system 40 can delay the feeding of a first receiving sheet 50 until the predetermined amount of time has passed. According to a further aspect of the invention, the intensity of the fluid flow could be varied as a function of the sheet heat absorbing capacity. In further embodiments, the predetermined time could remain unchanged, and the flow intensity varied as a function of sheet heat absorbing capacity. Further, the temperature of the cooling fluid could also be modulated as a function of sheet heat absorbing capacity. Variations and combinations of these concepts are evident in light of the description provided herein.

According to another aspect of the invention, a fuser 5 for fixing toner images to a receiving sheet 50 comprises a fuser roller 10, wherein the fuser roller 10 has opposing end portions 11, and a middle portion 16, a fuser roller heater 12, a logic and control system 40, a fuser roller temperature sensor 14, a source of cooling fluid 60, and a cooling device 70 for cooling the fuser roller 10, wherein the cooling device 70 cools the fuser roller middle portion 16.

In a preferred embodiment, the cooling device 70 further comprises a separate cooling device 71 for cooling the end portions 11, such that the cooling device 70 can cool either the middle portion 16 and/or the end portions 11. To more effectively simulate the run condition, according to an aspect of the invention, the length of the middle portion 16 is related to the width of the receiving sheet 50. For example, it may be approximately equal to, less than, or greater than the width of the receiving sheet, the ideal relationship being determined empirically. In a preferred embodiment, the cooling device 70 is adjustable such that as the receiver sheet 50 width changes, the cooling device 70 adjusts to cool the corresponding fuser middle portion 16. Thus, for 11 inch paper, the middle portion would equal 11 inches, and for 14 inch paper, the middle portion would be 14 inches. This adjustment could be done on the cooling device 70 for example by having various ports available for fluid flow, and closing or opening these port according to the width needing cooling.

In a further embodiment, the fluid directing device 70 further comprises a fluid directing device for directing the fluid onto the middle portion 76, and a separate fluid directing device for directing the fluid onto the end portions 71, such that the fluid directing device 70 can direct the fluid either at the middle portion 16 or at the end portions 11. This aspect is shown in FIGS. 3 and 4, where the fluid directing device for directing the fluid onto said middle portion 76 is a series of holes, slots, or other suitable openings, corresponding to the fuser roller middle portion 16, and the fluid directing device for directing the fluid onto the end portions 71 is an opening corresponding to the fuser roller end portions 11.

In a steady state run condition, the fuser roller end 11 temperature is greater than the fuser roller middle 16 temperature. This results in greater thermal expansion at the ends 11 of the fuser roller 10. The expanded, hotter ends 11 of the fuser roller 10 create differential overdrive with respect to the cooler smaller center of the fuser roller 10, this results in a differential 'tentering' force on the receiving sheets 50. According to a further aspect of the invention, a method of creating a desired tentering force on a receiving sheet 50 in a fuser 5 for fixing toner images to a receiving sheet 50, comprises cooling the middle portion 16 of the fuser roller 10 prior to the run condition, such that the end portions 11 are hotter than the middle portion 16. This may be controlled and maintained while sheets are being fed through the fuser, for example during steady state sheet feeding. In a preferred embodiment, the middle portion 16 is approximately equal to the receiver sheet 50 width. This tentering force could further be improved by grinding the fuser roller 10 to the desired optimum shape, such that the ends 11 are slightly expanded with respect to the middle portion 16, for example in a fusing system having a pressure roll and a fuser roll, by slightly modifying the shape of the fuser roller and/or pressure roller. The variance of pressure, in the form of a gradient of pressure that changes along the direction through the nip that is parallel to the axes of the rolls, can be established, for example, by continuously varying the overall diameter of the fuser and/or pressure roller along the direction of its axis such that the diameter is smallest at the midpoint of the axis and largest at the ends of the axis, in order to give the fuser roller and/or pressure roll a subtle "bow tie" or "hourglass" shape. This causes the pair of rolls to exert more pressure on the receiver sheet in the nip in the areas near the ends of the rolls than in the area about the midpoint of the rolls. This gradient of pressure helps to prevent wrinkles and cockle in the receiver sheet as it passes through the nip. A fuser roller is disclosed in United Patent Application Publication US 2004/0023144 A1, filed Aug. 4, 2003, in the names of Jerry A. Pickering and Alan R. Priebe, the contents of which are incorporated by reference as if fully set forth herein. Alternatively or in combination, the tentering force may also be improved by varying the degree of fuser roller and/or pressure roller bending.

According to further aspects of the invention, a roller 10 shape is provided to generate a tentering force for all sheet sizes. A constant temperature may be maintained along the length of the roller 10 by selective cooling along the length of the roller 10. In addition, a center portion of the roller 10 may receive greater cooling (heat removal) than end portions of the roller 10 prior to sheet feeding, and/or the end portions of the roller 10 may receive greater cooling (heat removal) than the center portion during sheet feeding).

According to further aspects of the invention, a desired temperature gradient along the length of the roller 10 is controlled and maintained by controlling cooling (heat removal) along the length of the roller 10. This temperature gradient may be chosen, in combination with the roller 10 profile, to provide a desired tentering force on the sheets. This temperature gradient may be controlled during feeding of sheets to maintain the desired tentering force on the sheet. Alone or in combination, the temperature gradient, and thus the cooling, may be varied as a function of time to vary from one sheet to the next in order to compensate for the various sheet variables previously described herein.

The logic and control 40 may be constructed and programmed according to methods and practices know in the relevant art. In this regard, it is contemplated that those skilled in the art having reference to this specification will be readily able to derive the specific computer program instructions suitable for a given logic and control to carry out the operations described herein, in the appropriate computer language.

The concepts disclosed herein may also be applied to the pressure roll 20, as an alternative, or in combination with applying them to the fuser roll 10.

The various aspects disclosed herein may be used alone or in combination, the invention not being limited to the specific examples presented herein, including the drawings. Numerous variations are possible, and may be evident to persons of ordinary skill in the relevant art, all of which are considered to fall within the purview of the invention.

We claim:

1. An improved method of operation of a fuser for fixing toner images to a receiving sheet, the fuser having a run condition and an idle condition, wherein the fuser has a fuser roller having end portions and a middle, a fuser roller heater, and a fuser temperature sensor which inputs to a logic and control system which controls the heating and cooling of the fuser roller heater, the improvement comprising:

cooling the fuser roller middle portion relative to the end portions during or after the idle condition;

creating a temperature profile along a fuser roller axial length resulting in a change in a fuser roller shape along the fuser roller axial length; and controlling the cooling and heating to maintain the fuser roller shape along the fuser roller axial length prior to the first receiving sheet entering the fuser and maintaining shape while the printing job is in steady state feeding.

2. The method of claim 1 wherein said cooled fuser roller middle portion is greater than the width of the receiving sheet.

3. The method of claim 1 wherein said cooled fuser roller middle portion is equal to the width of the receiving sheet.

4. The method of claim 1 wherein said cooled fuser roller middle portion is less than the width of the receiving sheet.

5. The method of claim 1 further comprising cooling said fuser roller for a predetermined amount of time.

6. The method of claim 1 further comprising cooling said fuser roller until said fuser roller achieves a predetermined temperature profile in space representing a predetermined fuser roller shape profile.

7. The method of claim 6 further comprising said logic and control system delaying the feeding of a first receiving sheet until said fuser roller achieves a predetermined temperature profile in space representing a predetermined fuser roller shape profile.

8. The method of claim 5 wherein said receiver sheet has a weight, further comprising said logic and control system adjusting said predetermined amount of time according to said receiver sheet weight.

9. The method of claim 8 further comprising said logic and control system delaying the feeding of a first receiving sheet until said predetermined amount of time has passed.

10. The method of claim 5 wherein said receiver sheet has at least one property, and further comprising said logic and control system adjusting said predetermined amount of time according to said at least one property.

11. The method of claim 10 further comprising said logic and control system delaying the feeding of a first receiving sheet until said predetermined amount of time has passed.

12. The method of claim 1 wherein said cooling is accomplished by blowing gas onto the fuser roller.

13. The method of claim 1 wherein said cooling is accomplished by a heat sink roller in contact with said fuser roller.

14. The method of claim 1 comprising cooling the end portions during the run condition relative a beginning of the run condition.

15. The method of claim 1 comprising cooling the fuser roller after the run condition.

16. A fuser for fixing toner images to a receiving sheet, the fuser comprising:

a fuser roller, wherein said fuser roller has a fuser roller length, opposing end portions, and a middle portion;

a fuser roller heater;

a logic and control;

a fuser roller temperature sensor; and, a cooling device for cooling said fuser roller along the fuser roller length, wherein said cooling device cools said fuser roller middle portion relative to the end portions to create a temperature profile along the fuser roller length resulting in a change in a fuser roller shape along the fuser roller length prior to the entry of the first receiving sheet into the fuser.

17. The fuser of claim 16 wherein said cooling device further comprises a separate cooling device for cooling said end portions, such that cooling device can cool either said middle portion or said end portions.

18. The fuser of claim 16 wherein said middle portion is approximately equal to the width of the receiving sheet.

19. The fuser claim 18 wherein said cooling device is adjustable such that as the receiver sheet width changes, the cooling device adjusts to cool the corresponding fuser middle portion.

20. The fuser of claim 16 wherein said cooling device is a fluid directing device for directing fluid at said fuser roller.

21. The fuser of claim 16 wherein said cooling device is a heat sink roller in contact with said fuser roller.

22. A method of creating a desired tentering force on a receiving sheet in a fuser for fixing toner images to a receiving sheet, the fuser having a run condition and an idle condition, wherein the fuser has a fuser roller having a middle portion and opposing end portions, a fuser roller heater, and a fuser temperature sensor which inputs to a logic and control system which controls the heating of the fuser roller heater, comprising the steps:

cooling the middle portion of the fuser roller prior to the run condition, such that the end portions are hotter than the middle portion;

creating a non-homogeneous temperature profile along a fuser roller axial length resulting in a change in a fuser roller shape along the fuser roller axial length; and controlling the cooling and heating to maintain the fuser roller shape along the fuser roller axial length prior to the first receiving sheet entering the fuser and maintaining shape while the printing job is in steady state feeding.

23. The method of claim 22 wherein the middle portion is greater than the receiver sheet width.

24. The method of claim 22 wherein the middle portion is equal to the receiver sheet width.

25. The method of claim 22 wherein the middle portion is less than the receiver sheet width.

26. The method of claim 22 wherein said cooling is accomplished by directing fluid onto said fuser roller.

27. The method of claim 22 wherein said cooling is accomplished by a heat sink roller contacting said fuser roller.

28. The method of claim 22 wherein said fuser roller is shaped such that the end portions have a slightly larger diameter than the middle portion.

29. The method of claim 22 comprising cooling the end portions during the run condition relative to a beginning of the run condition.

30. The method of claim 22 comprising cooling the fuser roller after the run condition.

31. The method of claim 22 comprising cooling only the middle portion after the run condition.

* * * * *